United States Patent [19]

Brownawell et al.

[11] Patent Number: 4,977,871

[45] Date of Patent: Dec. 18, 1990

[54] REMOVAL OF CARCINOGENIC HYDROCARBONS FROM USED LUBRICATING OIL USING ACTIVATED CARBON

[75] Inventors: Darrell W. Brownawell, Scotch Plains, N.J.; Donald J. Norris, Clearwater, Canada; Harold Shaub, Berkeley Heights, N.J.

[73] Assignee: Exxon Chemical Patents, Inc., Linden, N.J.

[21] Appl. No.: 250,617

[22] PCT Filed: Jan. 7, 1988

[86] PCT No.: PCT/GB88/00009

§ 371 Date: Nov. 7, 1988

§ 102(e) Date: Nov. 7, 1988

[87] PCT Pub. No.: WO88/05072

PCT Pub. Date: Jul. 14, 1988

[30] Foreign Application Priority Data

Jan. 7, 1987 [GB] United Kingdom ..... 8700241

[51] Int. Cl.[5] ..... F01M 1/00

[52] U.S. Cl. ..... 123/196 A; 210/282; 208/182; 252/9

[58] Field of Search ..... 123/196 R, 196 A; 184/6.24; 252/9, 10, 29, 22; 210/266, 416.5; 208/179, 182

[56] References Cited

U.S. PATENT DOCUMENTS

| | | | |
|---|---|---|---|
| 106,418 | 2/1943 | Allam . | |
| 106,419 | 2/1943 | Allam . | |
| 106,792 | 3/1943 | Halstead . | |
| 106,793 | 3/1943 | Halstead . | |
| 119,925 | 9/1884 | Sutt, Jr. . | |
| 464,661 | 5/1937 | Nicholson . | |
| 703,358 | 3/1941 | Miller et al. . | |
| 1,786,334 | 12/1971 | Zimmer . | |
| 2,251,130 | 5/1974 | Zimmer . | |
| 2,302,552 | 11/1942 | Johnson | 252/10 |
| 2,310,305 | 2/1943 | Miller et al. | 252/10 |
| 2,446,489 | 8/1948 | Schaafsma | 208/179 |
| 2,616,954 | 2/1977 | Hoger . | |
| 2,796,989 | 6/1957 | Kovacs | 210/282 |
| 2,915,930 | 10/1980 | Zimmer . | |
| 3,314,884 | 4/1967 | Cover | 252/10 |
| 3,336,223 | 8/1967 | Kneeland | 252/9 |
| 3,558,478 | 1/1971 | Geyer | 184/6.24 |
| 3,877,878 | 4/1975 | Kerfoot et al. . | |

OTHER PUBLICATIONS

Chemical Abstracts, vol. 83, No. 18, Nov. 3, 1975, p. 395, abstract 153193d and JP, A, 74123492.

Chemical Abstracts, vol. 83, No. 8, Aug. 25, 1975, and JP, A, 7435504, p. 284, No. 62997c.

*Primary Examiner*—E. Rollins Cross

*Attorney, Agent, or Firm*—Peter C. Bawden; John W. Ditsler

[57] ABSTRACT

A system for the substantial removal of polynuclear aromatic compounds from lubricating oil used to lubricate the engine of a motor vehicle comprising a sorbent located within the lubricating system and through which the lubricating oil circulates which is capable of removing substantially all of the polynuclear aromatic hydrocarbons from the lubricating oil. The sorbent is preferably activated carbon which may be impregnated with additives typically found in lubricating oils especially antioxidants, to prolong the useful life of the oil.

27 Claims, 3 Drawing Sheets

REMOVAL OF CARCINOGENIC HYDROCARBONS FROM USED LUBRICATING OIL USING ACTIVATED CARBON

The present invention relates to the removal of carcinogenic agents (such as polynuclear aromatic compounds) and heavy metals (such as lead and chromium) from used lubricating oils.

Polynuclear aromatic compounds, especially those containing three or more aromatic nuclei, are frequently present in relatively small quantities in used lubricating oil, especially from gasoline engines where the high temperatures during engine operation tend to promote the formation of polynuclear aromatics in the oil. This leads to polynuclear aromatic concentrations higher than 100 parts per million renders disposal of the used oil hazardous.

According to this invention, carcinogenic agents (such as polynuclear aromatic hydrocarbons) and heavy metals (such as lead and chromium) can be significantly removed from lubricating oil used to lubricate the engine of a motor vehicle by the use of a system comprising a sorbent positioned within the lubricating system and through which the lubricating oil circulates, which is capable of removing substantially all of the polynuclear aromatic hydrocarbons from the lubricating oil.

The system of this invention is used in the lubricating system of a motor vehicle and is particularly suitable for gasoline engines, but it can be used for diesel engines. It is only necessary to have the sorbent located at a position in the lubricating system through which the lubricating oil must be circulated after being used to lubricate the moving parts of the engine. In a preferred embodiment the sorbent is part of the filter system provided for filtering oil, or it may be separate therefrom. The sorbent can be conveniently located on the engine, block or near the sump, preferably downstream of the oil as it circulates through the engine, ie after it has been heated. The system of the present invention may be used in automotive engines, railroad, marine and truck engines which may be gasoline, diesel, heavy fuel or gas-fired.

This means that the polynuclear aromatic hydrocarbons are removed by the sorbent during the normal flow of the lubricating oil through the system and they may, therefore, be removed and readily disposed of simply by removal of the sorbent. The polynuclear aromatics to be removed generally contain 3 or more aromatic rings and the present invention is far simpler than the currently required disposal of large volumes of lubricating oil having a high polynuclear aromatic hydrocarbon content.

Suitable sorbents comprise attapulgus clay, silica gel, molecular sieves, dolomite clay, alumina or zeolite, although we prefer to use activated carbon. It may be necessary to provide a container to hold the sorbent, such as a circular mass of sorbent supported on wire gauze. Alternatively the filters could comprise the solid compound capable of combining with polynuclear aromatic hydrocarbons held in pockets of filter paper.

We prefer to use active carbon since it is selective to the removal of polynuclear aromatics containing more than 3 aromatic rings. It has the added advantage that the polynuclear aromatics are tightly bound to the carbon and cannot be leached out to provide free polynuclear aromatics after disposal. Furthermore the polynuclear aromatics contained will not be redissolved in the used engine oil as it circulates. We also prefer to use activated carbon since it will also remove heavy metals such as lead and chromium from the lubricating oil Particular types of activated carbons are advantageous for removal of polynuclear aromatics. Although most activated carbons will remove polynuclear aromatics to some extent, we have found particular types are preferred for removal of 3 and 4 ring aromatics. Characteristics such as active surface area and pore structure were found to be less important than the materials from which the activated carbon had been made. Wood and peat based carbons were significantly more effective than carbons derived from coal or coconut, presumably due to the combination of surface active species and a pore structure allowing large polynuclear aromatics access to the surface active species The amount of sorbent required will depend upon the concentration of the polynuclear aromatic compounds in the lubricating oil, but about 50 to 150 grams of the activated carbon can reduce the polynuclear aromatic content of the lubricating oil, eg used engine oil, by up to 90%. Used engine oils usually contain 10 to 10,000, eg 10 to 4,000 ppm of polynuclear aromatic compounds.

In a preferred form of the present invention, the sorbent is mixed or coated with additives traditionally present in lubricating oils, which may be taken up by the lubricating oil to replenish the additives as they become depleted. Typical examples of such additives are dispersants, antiwear additives, antioxidants, friction modifiers, detergents and pour depressants. This is particularly useful when the additive is a compound included to give antioxidant properties to the oil. We have found that this not only results in removal of the polynuclear aromatics from the oil, but also extends the useful life of the lubricating oil. Examples of such antioxidants are the zinc dialkyldithiphosphates, which can also act as anti-wear additives, and the alkyl phenols and alkyl phenol sulphides, which are frequently used as such antioxidants. The ease with which the additive is released into the oil depends upon the nature of the additive we prefer it to be totally released within 150 hours of operation of the engine. We prefer that the sorbent contain from 50 to 100% by weight based on the weight of activated carbon of the lubricant additive which generally corresponds to 0.5 to 1.0 wt % of the additive in the lubricant.

We have found that the preferred embodiment of the present invention not only results in removal of the polynuclear aromatics from the oil, but also extends the useful life of the lubricating oil.

We have found that polynuclear aromatic compounds, especially those with three or more rings, can be substantially removed (ie a reduction of 60% to 80%) from the lubricating oils. Examples of trinuclear aromatic compounds which are removed are phenanthrene, anthracene and 9,10-dihydroanthracene. Examples of tetranuclear aromatic compounds which are removed are pyrene, 1,2-benzanthracene, chrysene, tetracene and fluoranthrene, whilst examples of pentanuclear aromatic compounds which are removed are dibenzanthracene, benzo(e)pyrene, benzo(b)fluoranthene, benzo(k)fluoranthene and benzo(a)pyrene. Examples of hexanuclear aromatic compounds which are removed are benzo(phi)perylene and coronene.

We have found that the use of the system of the present invention has the added advantage (particularly when activated carbon is the sorbent) that the sorbent also removes heavy metals, such as lead and chromium, from the lubricating oil.

EXAMPLE 1

Figure 1:
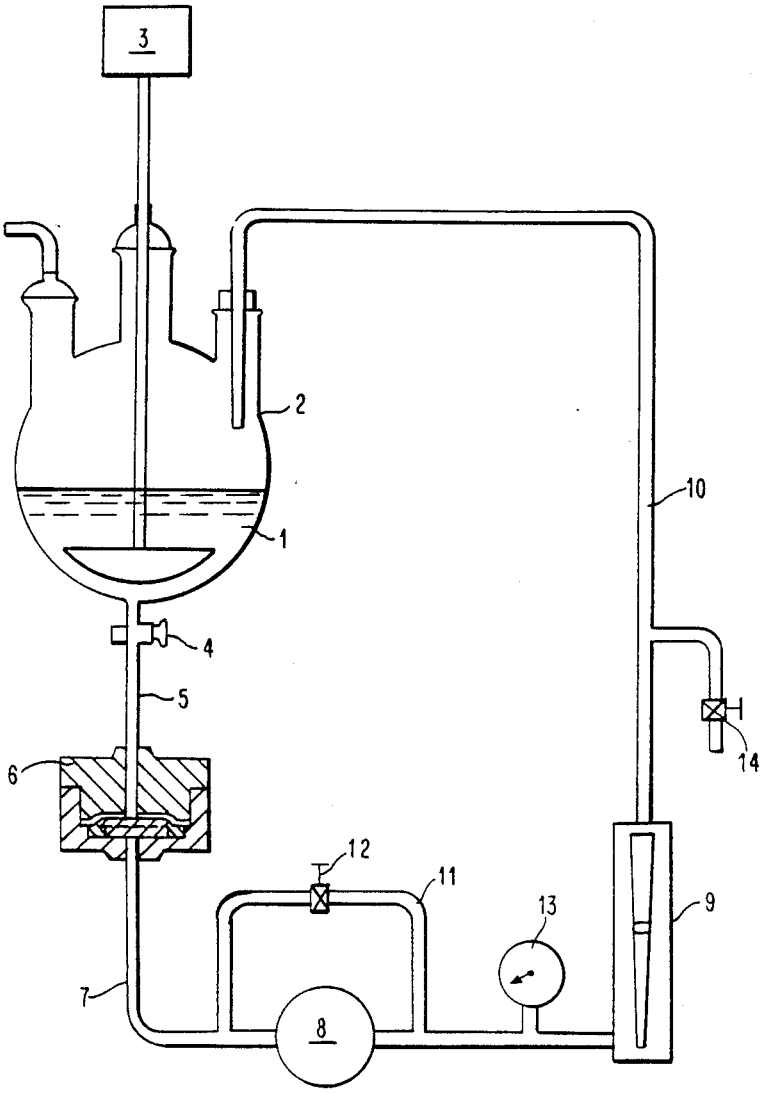
FIG. 1 is schematic diagram of the test apparatus used to obtain the data in Examples 1–3 below.

In this Example, the laboratory apparatus was used for testing the removal of polynuclear aromatics from used motor oils is illustrated in FIG. 1.

Referring to FIG. 1, the used motor oil 1 was placed in a 250 ml flask 2 provided with a stirrer 3. Tubing 5 provided with a tap 4 connects the bottom of the flask 2 with a teflon filter unit 6. Connected downstream of this filter unit 6 is tubing 7 provided with a pump 8 connecting to a rotameter 9 to measure the rate of flow of oil. Tubing 10 connects the rotameter 9 with the flask 2. The pump 8 is provided by with a bypass 11 having a tap 12 and a gauge 13 can measure the oil pressure in tubing 7. Finally there is a drain tap 14.

Several runs were made using various activated carbons in the filter sandwiched between two sheets of commercial oil filter paper. The properties of the activated carbons used are given in Table 1 as is the removal of polynuclear aromatics after treatment for approximately 100 hours.

TABLE 1

PROPERTIES OF ACTIVATED CARBONS USED FOR PNA REMOVAL

| Carbon | Source | pH | Iodine No. | Molasses No. | Surface Area ($m^2/g$) | Mean Pore Radius[1] (Å) | Pore Volume[1] (cc/g) |
|---|---|---|---|---|---|---|---|
| NUCHAR WV-8 | Wood | 6.3 | 950 | 370 | 1700 | 43 | 0.85 |
| NORIT PK-0.25 | Peat | 10.2 | 850 | 80 | 700 | 21 | 0.82 |
| NORIT RO-0.8 | Peat | 9.9 | 1100 | 95 | 1000 | 19 | 0.68 |
| CALGON APC | Bituminous | 7.5 | 1250 | 530 | 1500 | 34 | 0.81 |
| CALGON CAI | Bituminous | 7.5 | 1020 | 190 | 1050 | 30 | 0.45 |
| HYDROCARBON 5000 | Lignite | 5.7 | 600 | 170 | 625 | 21 | 0.64 |
| Commercial | Coconut | | | | | | |

| Carbon | Pore Volume Distribution[1] | | | | PNA Removal | |
|---|---|---|---|---|---|---|
| | <35 Å | 35–100 | 100–1000 | >1000 Å | Residual PNA | % |
| NUCHAR WV-8 | 0.15 | 0.23 | 0.22 | 0.25 | 837 | 89% |
| NORIT PK-0.25 | 0.08 | 0.12 | 0.14 | 0.5 | 873 | |
| NORIT RO-0.8 | 0.05 | 0.09 | 0.17 | 0.37 | | 81–87% |
| CALGON APC | 0.13 | 0.16 | 0.20 | 0.32 | 1073 | |
| CALGON CAI | 0.09 | 0.07 | 0.16 | 0.13 | | ~60% |
| HYDROCARBON 5000 | 0.10 | 0.18 | 0.18 | 0.17 | 1127 | |
| Commercial | | | | | | 43% |

[1]Based on pores >18 Å radius.

EXAMPLE 2

The NORIT RO-0.8 activated carbon used in EXample 1 was used in engine tests both in an engine laboratory and in field trials with Esso Extra Motor Oil. In these tests the polynuclear aromatic content of the lubricating oil when using a traditional filter was compared with that when the traditional filter was replaced with one also containing the activated carbon and impregnated with about an equal weight based on carbon of a zinc dialkyl dithiophosphate (known as chemical filter).

Figure 2:
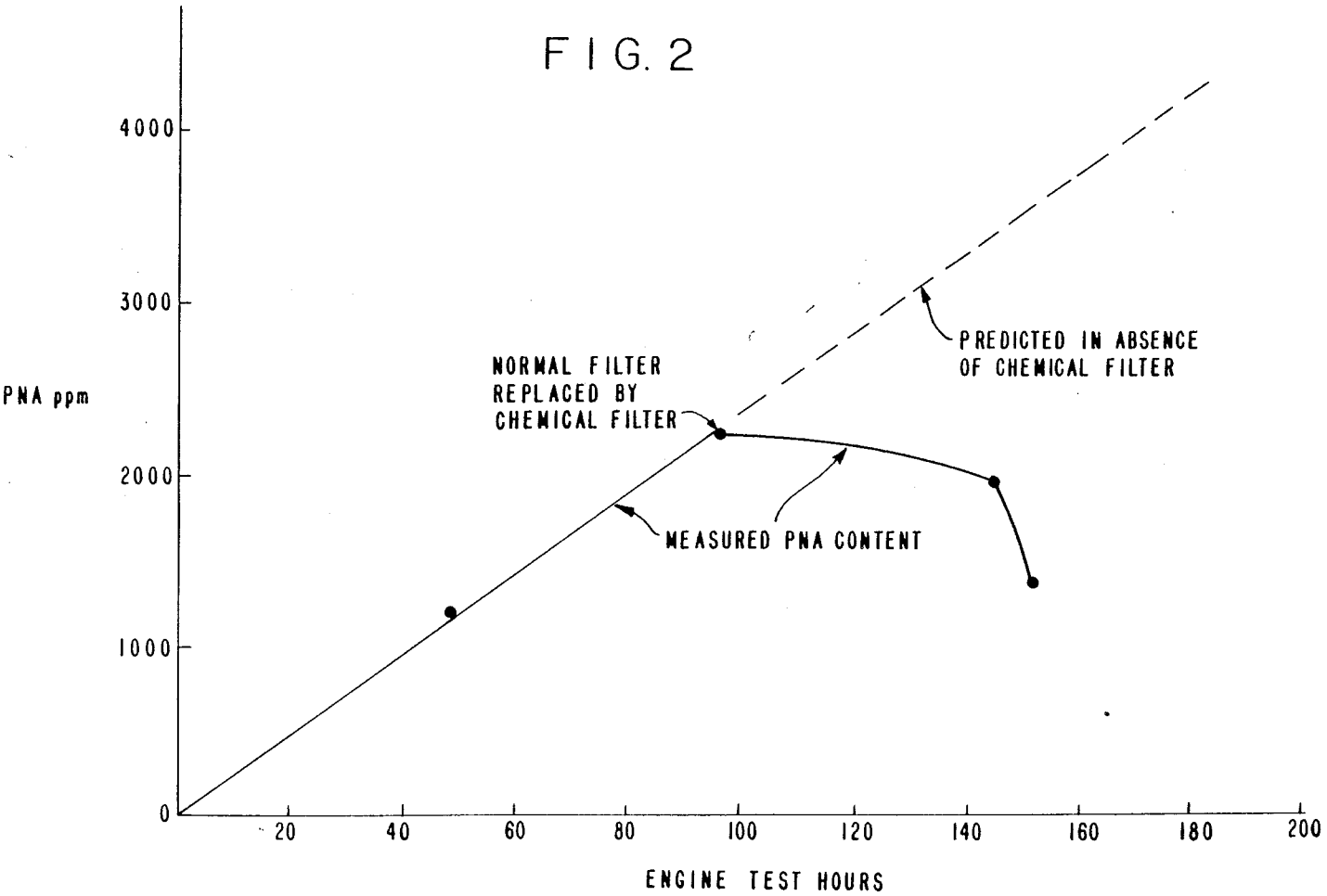
FIGS. 2 and 3 are graphs of lubricating oil PNA content versus time for conventional filters systems and the filter system of this invention.

In the first laboratory test, a Fiat engine was run in the laboratory for 100 hours on a normal filter followed by 51.5 hours using the chemical filter of the invention. The PNA content of the lubricating oil at various times is shown in FIG. 2 and by dividing measured ppm PNA @ 151.5 hours by estimated PNA content at 151.5 hours using the normal filter result extrapolated from 100 hours (see FIG. 2), we can see that inserting the chemical filter of the invention resulted in about 62% reduction of 4,5 and 6 ring PNAs.

Figure 3:
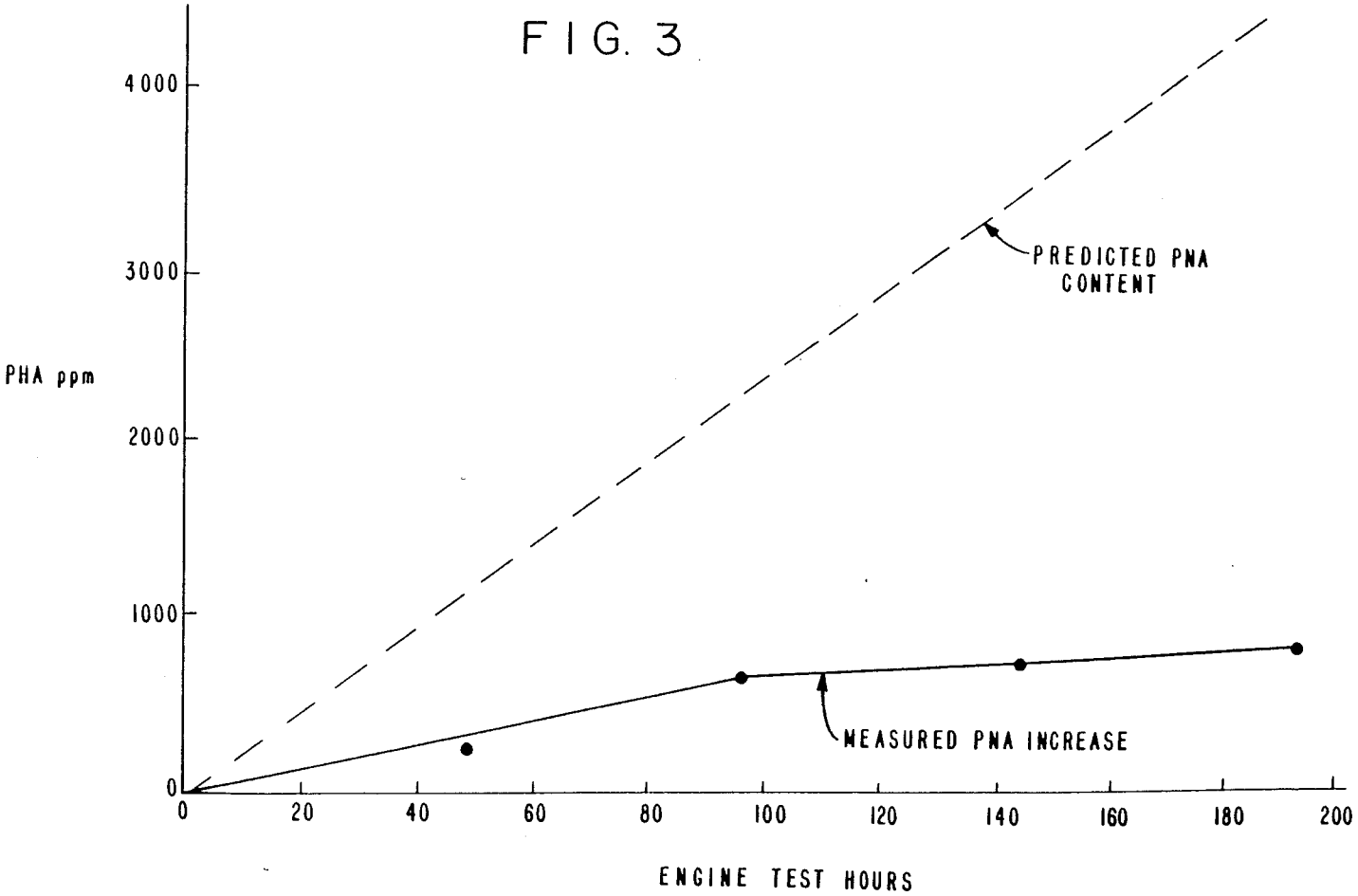

FIG. 3 shows the PNA content of the lubricating oil during a 192-hour test using the chemical filter throughout in a similar engine, and includes the predicted PNA content when using a normal filter.

It was also found that after a 96 hour test using a normal filter the oil contained 2320 ppm of lead and 3.2 ppm of chromium whilst after a similar 96 hour trial using a chemical filter the lead content was 1410 ppm and the chromium content was below 0.2 ppm.

In a car test, the car was driven 3,000 miles using a normal filter followed by 3,000 miles using a chemical filter. Data calculated by dividing the 6,000 mile PNA content by $\frac{3}{4}$ of the PNA content at 8,000 mile from a separate experiment shows about 83% reduction of 4,5 and 6 ring PNAs by use of the chemical filter.

The oxidation stability of the oil was determined by measuring the Differential Scanning Calorimeter break temperature. The DSC measures the exothermic reaction inside the oil as its temperature increases. Thus when an oil loses its oxidative stability (i.e. the antioxidants are consumed), a large exotherm takes place. A higher DSC temperature thus indicates a more oxidatively stable oil. During the laboratory test with the Fiat engine the oxidative stability was found to be as follows

| Filter | Hours on Test | DSC Break Temp. °C. |
|---|---|---|
| Normal | 0 | 246 |
| Normal | 48 | 225 |
| Normal | 96 | 225 |
| Chemical | 144 | 225 |
| Chemical | 151.5 | 236 |

The DSC break temperature for the oil used in the car trials was also measured and found to be:

| Thousands of miles on Total Test | Thousands of miles using Chemical Filter | DSC Break Temp. °C. |
|---|---|---|
| 0 | | 246 |
| 4 | 1 | 216 |
| 5 | 2 | 234 |

-continued

| Thousands of miles on Total Test | Thousands of miles using Chemical Filter | DSC Break Temp. °C. |
|---|---|---|
| 6 | 3 | 235 |

The filter was changed to the chemical filter after 3,000 miles.

Example 3

In a simulated experiment polynuclear azomatics were added to a lubricating oil together with tertiary butyl hydroperoxide to promote oxidation. The oil was then tested in the rig used in Example 1 using activated carbon impregnated with various antioxidants as the sorbent medium. The DSC break temperature of the lubricating oil at the end of the test was measured and the results given in the following Table.

| Experiment | mg PNA | grs Carbon | grs Antiodixant | ml t-BHPO | DSC Break Temp. °C. |
|---|---|---|---|---|---|
| 1 | | | | | 246 |
| 2 | | | | 12 | 215 |
| 3 | 36 | 6 | | 12 | 216 |
| 4 | 36 | 3 | *3 | 12 | 236 |
| 5 | 36 | 3 | **3 | 12 | 245 |

*of zinc dialkyl dithiophiosphate
**of a blend of a zinc dialkyl dithiophosphate and nonyl phenyl sulphide.

The DSC data demonstrates that releasing antioxidant from the sorbent can restore the oxidative stability of the lubricant.

We claim:

1. A system for the selective removal of polynuclear aromatic hydrocarbons containing 3 or more aromatic rings from lubricating oil used to lubricate the engine of a motor vehicle which comprises activated carbon positioned within the lubricating system and through which the lubricating oil circulates, said activated carbon being selective to removing polynuclear aromatic hydrocarbons containing 3 or more aromatic rings from the lubricating oil.

2. A system according to claim 1 in which the activated carbon is impregnated with one or more additives of the type generally used in automotive lubricating oils.

3. A system according to claim 2 in which the additive is an antioxidant.

4. Activated carbon impregnated with an additive typically found in automotive lubricating oils suitable for use in a system according to claim 1.

5. Activated carbon according to claim 4 in which the additive is an antioxidant.

6. Activated carbon according to claim 4 in which the additive is an antiwear agent,

7. The system of claim 1 wherein the polynuclear aromatic hydrocarbons removed have 4, 5, and 6 aromatic rings.

8. The system of claim 7 wherein the lubricating oil contains a metal which is also removed from the oil.

9. The system of claim 8 wherein the metal is lead or chromium.

10. The system of claim 2 wherein the additive comprises zinc dialkyldithiophosphate.

11. The system of claim 1 wherein the surface area of the activated carbon ranges from 700 to 1700 $m^2/g$.

12. A method for the selective removal of polynuclear caromatic hydrocarbons having 3 or more aromatic rings from a lubricating oil used to lubricate an engine which comprises (a) positioning activated carbon within the lubrication system of the engine, and (b) contacting the lubricating oil with the activated carbon for a period of time sufficient to selectively remove polynuclear aromatic hydrocarbons having 3 or more aromatic rings from the oil.

13. The method of claim 13 wherein the polynuclear aromatic hydrocarbons removed have 4, 5, and 6 aromatic rings.

14. The method of claim 13 wherein the lubricating oil contains a metal which is also removed from the oil.

15. The method of claim 14 wherein the metal is lead or chromium.

16. The method of claim 13 wherein 3 and 4 ring polynuclear aromatic hydrocarbons are removed.

17. The method of claim 12 wherein the activated carbon is impregnated with one or more additives of the type generally used in lubricating oil.

18. The method of claim 17 wherein the additive is an antiwear agent.

19. The method of claim 17 wherein the additive is an antioxidant.

20. The method of claim 17 wherein the additive comprises zinc dialkyldithiophosphate.

21. The method of claim 13 wherein the activated carbon is impregnated with one or more additives of the type generally used in lubricating oils.

22. The method of claim 21 wherein the additive is an antioxidant.

23. The method of claim 21 wherein the additive comprises zinc dialkyldithiophosphate.

24. The method of claim 12 wherein the activated carbon is positioned within the filter system of the engine.

25. The method of claim 12 wherein the surface area of the activated carbon ranges from 700 to 1700 $m^2/g$.

26. The system of claim 1 wherein substantially all of the polynuclear aromatic hydrocarbons removed have 4, 5, and 6 aromatic rings.

27. The method of claim 12 wherein substantially all of the polynuclear aromatic hydrocarbons removed have 4, 5, and 6 aromatic rings.

* * * * *